US012253330B2

(12) United States Patent
Hines

(10) Patent No.: US 12,253,330 B2
(45) Date of Patent: Mar. 18, 2025

(54) FITTED RIFLE SLING WITH QUICK RELEASE APPARATUS AND METHOD OF USE

(71) Applicant: William Scott Hines, Keizer, OR (US)

(72) Inventor: William Scott Hines, Keizer, OR (US)

( * ) Notice: Subject to any disclaimer, the term of this patent is extended or adjusted under 35 U.S.C. 154(b) by 34 days.

(21) Appl. No.: 18/178,702

(22) Filed: Mar. 6, 2023

(65) Prior Publication Data

US 2024/0302130 A1 Sep. 12, 2024

(51) Int. Cl.
*F41C 33/00* (2006.01)
*F41C 23/02* (2006.01)

(52) U.S. Cl.
CPC ..... *F41C 33/002* (2013.01); *F41C 23/02* (2013.01)

(58) Field of Classification Search
CPC ..... F41C 33/002; F41C 23/02
USPC ..... 224/150
See application file for complete search history.

(56) References Cited

U.S. PATENT DOCUMENTS 5,246,154 A * 9/1993 Adams ..... F41B 5/1461 224/916
5,305,540 A 4/1994 Blenk
7,059,502 B2 6/2006 Johnson
8,733,601 B2 5/2014 Burnsed, Jr.
9,528,795 B1 12/2016 Burnsed, Jr.
9,746,284 B2 * 8/2017 McCarthy ..... F41C 33/002
9,791,237 B1 10/2017 Burnsed, Jr.
10,281,234 B1 5/2019 Burnsed, Jr.
10,473,424 B2 * 11/2019 Weimer ..... F41C 23/02
10,634,451 B1 4/2020 Thompson
11,085,731 B2 8/2021 Freitas
11,243,047 B1 2/2022 Thompson
11,280,581 B1 * 3/2022 Ollivier ..... F41C 33/001
11,859,944 B1 * 1/2024 Burnsed, Jr. ..... F41C 33/002
2010/0206921 A1 8/2010 Shen
2016/0123698 A1 5/2016 Gellert
2020/0224999 A1 * 7/2020 Brown ..... F41C 33/002
2020/0278175 A1 * 9/2020 Lance ..... F41C 23/02
2024/0247908 A1 * 7/2024 Burnsed, Jr. ..... A45C 13/30

FOREIGN PATENT DOCUMENTS

CA 2688932 A1 6/2010
CA 2688932 C * 12/2016 ..... F41C 23/02

* cited by examiner

*Primary Examiner* — Justin M Larson
(74) *Attorney, Agent, or Firm* — Carson Patents; Gregory D Carson

(57) ABSTRACT

The present invention is a fitted rifle sling with quick release apparatus and method of use wherein this rifle sling can be snuggly fitted to the sides of a rifle for stowage of the sling during use of the rifle and quickly released for use as a sling over the shoulder or for attachment to a webbing or body gear wearing system. The present invention offers a rifle sling wherein all of the components and elements can be complaint with military specifications and/or pouch attachment ladder system compliant construction.

19 Claims, 2 Drawing Sheets

FITTED RIFLE SLING WITH QUICK RELEASE APPARATUS AND METHOD OF USE

BACKGROUND OF THE INVENTION

Technical Field

The present invention relates generally to a sling for carrying a rifle. The present invention relates to sling for carrying a rifle in the form of an apparatus having a quick release adjustable length rifle sling. The present invention relates to sling for carrying a rifle in the form of an apparatus having a quick release adjustable length rifle sling that is fitted to the sides of a rifle.

The present invention relates to sling for carrying a rifle in the form of an apparatus having a quick release adjustable length rifle sling that is fitted to the sides of a rifle held in position with a quick release locking string.

The present invention relates to sling for carrying a rifle in the form of an apparatus having a quick release adjustable length rifle sling that is fitted to the sides of a rifle held in position with a quick release locking string that is adaptable to incorporate and comply with the military specifications and pouch attachment ladder system.

Background Art

There are various kinds and types of slings available for rifles. There are adjustable length rifle slings. There are rifle slings that incorporate and comply with the military specifications (Mil Spec) and the pouch attachment ladder system (PALS).

What is not present in the current prior art is a rifle sling that is adjustable and includes a sling that can be held in place when fitted to the sides of the rifle and can be quick released to sling carry or worn stowage of the rifle with a simple pull of a tab and/or string loop.

In light of the foregoing prior art, there is a need for a rifle sling to better store the sling on the rifle while the rifle is in use, and be able to very rapidly release the stowed sling and use it as a sling to carry a rifle.

BRIEF SUMMARY OF THE INVENTION

The present invention is a rifle sling that can be snuggly fitted to the sides of a rifle for stowage of the sling during use of the rifle and quickly released for use as a sling or for attachment to a webbing or gear wearing system.

According to a first aspect of the invention there is a rifle sling comprising a first strap comprising a first tri-glide buckle, a second tri-glide buckle, a webbing, and a web dominator having a first cord loop comprising a pull tab connectively attached to said first cord loop, a second strap comprising a third tri-glide buckle, and a spring loaded cam buckle having a position release tab wherein a second cord loop is connectively attached to said quick release tab and said second cord loop is wrapped with a cord covering, and a d-ring operatively connected between said first strap and said second strap for enabling stowage of the sling snuggly to the sides of a rifle during use of the rifle and quickly released for use as a sling or for attachment to a webbing or gear wearing system.

According to a second aspect of the invention there is a rifle sling as in the first aspect wherein said first strap comprises a first length that is longer than a second length of said second strap.

According to a third aspect of the invention there is a rifle sling as in the first aspect wherein said first strap and said second strap comprise a military specification material.

According to a fourth aspect of the invention there is a rifle sling as in the first aspect wherein said webbing comprises a military specification material.

According to a fifth aspect of the invention there is a rifle sling as in the first aspect wherein said webbing comprises a pouch attachment ladder system compliant construction.

According to a sixth aspect of the invention there is a rifle sling as in the first aspect wherein said first cord loop comprises a shock cord.

According to a seventh aspect of the invention there is a rifle sling as in the first aspect wherein said second cord loop comprises a shock cord.

According to an eighth aspect of the invention there is a rifle sling as in the first aspect comprising a short attachment end comprising a short cord loop connectively attached to a first loop lock, and a long attachment end comprising a long cord loop connectively attached to a second loop lock wherein said long cord loop is longer than said short cord loop, optionally wherein connectively attached is by means of a first webbing material looped through said first loop lock forming two sides that are then sewn over said short cord loop for short attachment end and a second webbing material looped through said second loop lock forming two sides that are then sewn over said long cord loop for long attachment end, and optionally wherein said short cord loop and said long cord loop comprise positive locking cord.

According to a ninth aspect of the invention there is method of using a rifle sling comprising a first strap comprising a first tri-glide buckle, a second tri-glide buckle, a webbing, and a web dominator having a first cord loop comprising a pull tab connectively attached to said first cord loop, a second strap comprising a third tri-glide buckle, and a spring loaded cam buckle having a position release tab wherein a second cord loop is connectively attached to said quick release tab and said second cord loop is wrapped with a cord covering, and a d-ring operatively connected between said first strap and said second strap on a rifle having a barrel end and a stock end for use of said rifle while said rifle sling is operatively attached comprising: 1) attaching a short attachment end having a short cord loop connectively attached to a first loop lock to said barrel end of said rifle by looping said short cord loop through a first opening on said barrel end and passing said first loop lock through said short cord loop, looping said first strap through said first loop lock, 2) attaching a long attachment end having a long cord loop connectively attached to a second loop lock to said stock end of said rifle by looping said long cord loop through a second opening on said stock end and passing said second loop lock through said long cord loop, 3) looping said second strap through said second loop lock, 4) positioning said first strap along side said rifle, 5) positioning said second strap along side said rifle, 6) folding said second strap to remove any slack between said rifle and said rifle sling, and 7) positioning and locking said position release tab on said spring loaded cam buckle along said first strap tightening said rifle sling to a left and a right side of said rifle.

An advantage of the fitted rifle sling with quick release apparatus and method of use is the ease of stowage on the rifle during use and the ability to quickly relate the sling from stowage position to use or for attachment to a a webbing or gear wearing system.

The invention will now be described, by way of example only, with reference to the accompanying drawings in which:

DETAILED DESCRIPTION OF THE INVENTION

The detailed embodiments of the present invention are disclosed herein. The disclosed embodiments are merely exemplary of the invention, which may be embodied in various forms. The details disclosed herein are not to be interpreted as limiting, but merely as the basis for the claims and as a basis for teaching one skilled in the art how to make and use the invention.

References in the specification to "one embodiment," "an embodiment," "an example embodiment," etcetera, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

All illustrations, figures, or drawings are for the purpose of describing selected versions of the present invention and are not intended to limit the scope of the present invention. Webbing refers to flat, strong, tightly woven strips of fabric used for various purposes including but not limited to use with military tactical gear, recreational activities, and load securing. A tri-glide buckle refers to a buckle used on webbing to adjust the length of the webbing. A web dominator refers to a clip attachable to webbing with a shock cord fastened for securing other cords or straps.

Figure 1:
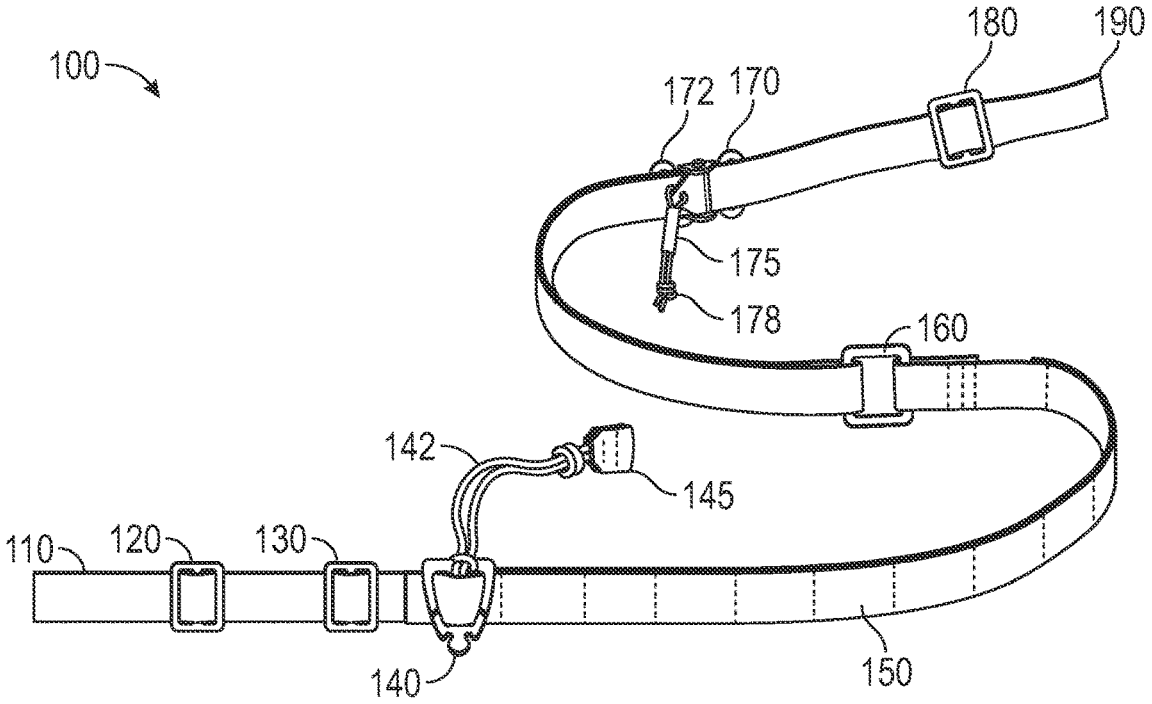
FIG. 1 is a perspective view of the rifle sling according to the invention.
Figure 2:
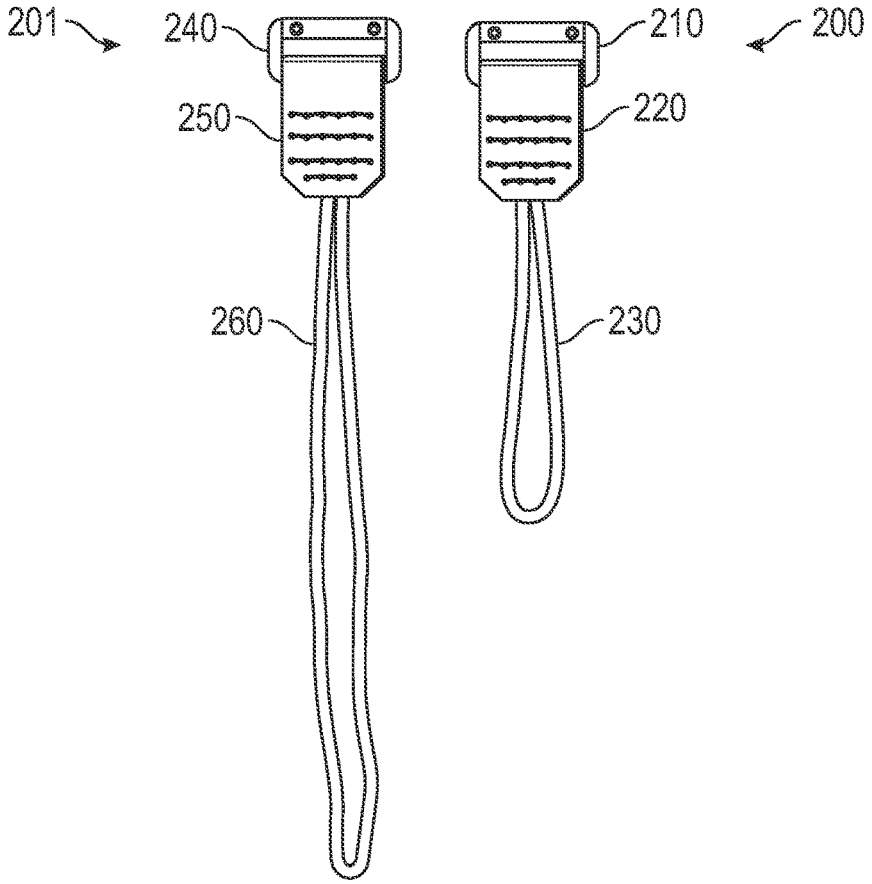
FIG. 2 is a view showing a short loop lock end and a long loop lock end according to the invention.
Figure 3:
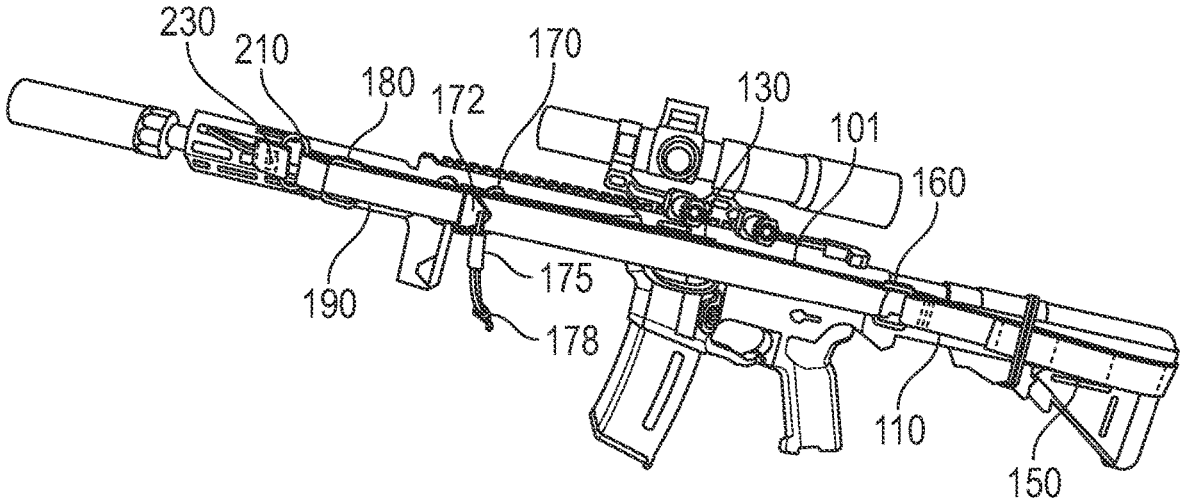
FIG. 3 is perspective view showing the rifle sling of the present invention attached to a rifle from the left side of the rifle.
Figure 4:
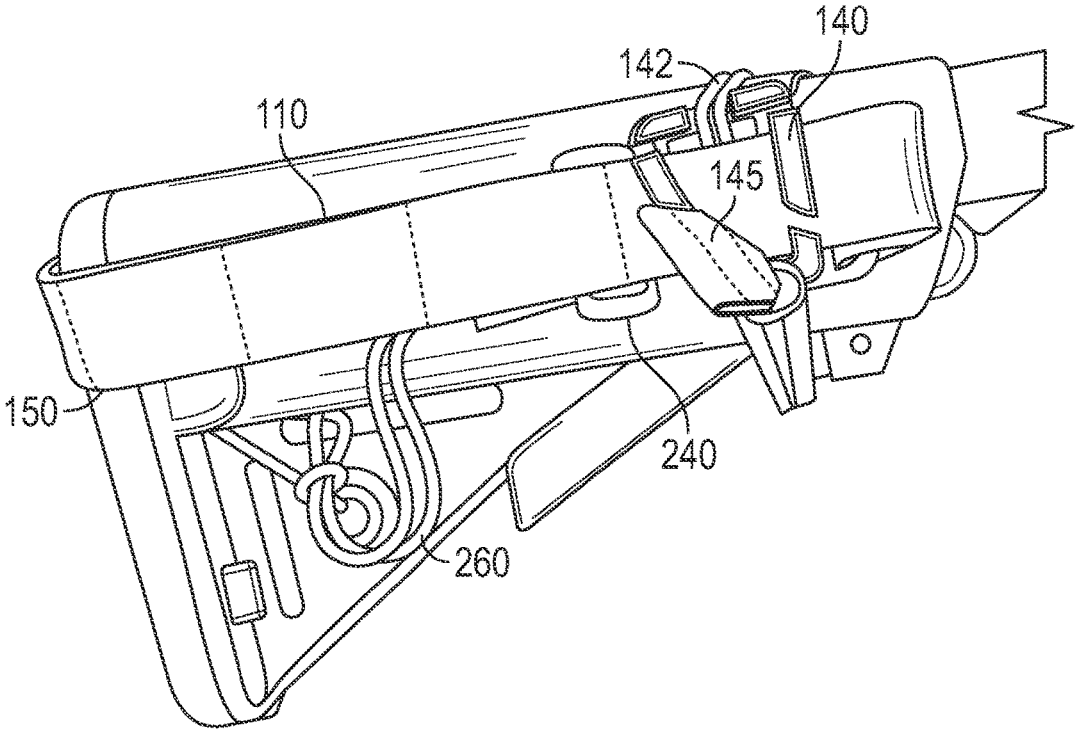
FIG. 4 is perspective view showing the rifle sling of the present invention attached to a rifle from the right side of the rifle.

Referring to the Figures, there is shown in FIGS. 1, 2, 3, and 4 the following features listed in numeric order.

Element 100 is a rifle sling.
Element 101 is a rifle.
Element 110 is a first strap.
Element 120 is a first tri-glide buckle.
Element 130 is a second tri-glide buckle.
Element 140 is a web dominator.
Element 142 is a first cord loop (shock cord).
Element 145 is a pull tab sewn onto and over a shock cord.
Element 150 is a webbing (fabric).
Element 160 is a first d-ring.
Element 170 is a spring loaded cam buckle.
Element 172 is a position release tab for said spring loaded cam buckle 170.
Element 175 is a cord covering (shrink wrap covering).
Element 178 is a second cord loop (positive locking cord).
Element 180 is a third tri-glide buckle.
Element 190 is a second strap.
Element 200 is short attachment end for connecting the rifle sling 100 to a rifle 101.
Element 201 is long attachment end for connecting the rifle sling 100 to a rifle 101.
Element 210 is a first loop lock.
Element 220 is a sewn in place connective attachment between the first loop lock 210 and its attachment cord.
Element 230 is a short cord loop (positive locking cord).
Element 240 is a second loop lock.
Element 250 is a sewn in place connective attachment between the second loop lock 240 and its attachment cord.
Element 260 which is a long cord loop (positive locking cord).

Manufacturing or making the device of the present invention is accomplished with looping cords/strings and/or sewing fabric tabs to connect to and attach to cords/strings as shown in the figures, and assembling the elements (parts) of the sling from already manufactured components. Other means of attachment includes adhesives and the manufacture of combinations of elements/parts can be used to make the sling of the present invention.

All cords and strings used may be any of the shock cords, positive locking cords, and any other cord, fiber, or string that would offer the flexibly of position and place holding action as available from the shock cords and positive locking cords well known in the art. Both natural and manufactured cords and strings may be used. Materials that are naturally water resistant are preferred, but this in no way limits the available options for cord, fiber, or string that would offer the flexibly of position and place holding action need to enable the quick release function of the present invention.

In a preferred embodiment of the present invention there is a rifle sling comprising a first strap comprising a first tri-glide buckle, a second tri-glide buckle, a webbing, and a web dominator having a first cord loop comprising a pull tab connectively attached to said first cord loop, a second strap comprising a third tri-glide buckle, and a spring loaded cam buckle having a position release tab wherein a second cord loop is connectively attached to said quick release tab and said second cord loop is wrapped with a cord covering, and a d-ring operatively connected between said first strap and said second strap. The cords are sewn to the tabs by placing the cord between two folded sides on a single fabric or strap folded in half with the cord ends places between the folded fabric or straps sides and sewn into place. Other means of connective attachment include adhesives.

In an alternative embodiment of the present invention there is a rifle sling wherein said first strap comprises a first length that is longer than a second length of said second strap.

In an alternative embodiment of the present invention there is a rifle sling wherein said first strap and said second strap comprise a military specification material.

In an alternative embodiment of the present invention there is a rifle sling wherein said webbing comprises a military specification material.

In an alternative embodiment of the present invention there is a rifle sling wherein said webbing comprises a pouch attachment ladder system compliant construction.

In an alternative embodiment of the present invention there is a rifle sling wherein said first cord loop comprises a shock cord.

In an alternative embodiment of the present invention there is a rifle sling wherein said second cord loop comprises a shock cord.

In an alternative embodiment of the present invention there is a rifle sling comprising a short attachment end comprising a short cord loop connectively attached to a first loop lock, and a long attachment end comprising a long cord loop connectively attached to a second loop lock wherein said long cord loop is longer than said short cord loop.

In an alternative embodiment of the present invention there is a rifle sling wherein connectively attached is by means of a first webbing material looped through said first loop lock forming two sides that are then sewn over said short cord loop for short attachment end and a second webbing material looped through said second loop lock forming two sides that are then sewn over said long cord loop for long attachment end.

In an alternative embodiment of the present invention there is a rifle sling wherein said short cord loop and said long cord loop comprise positive locking cord.

In a preferred embodiment of the present invention there is a method of using a rifle sling comprising a first strap comprising a first tri-glide buckle, a second tri-glide buckle, a webbing, and a web dominator having a first cord loop comprising a pull tab connectively attached to said first cord loop, a second strap comprising a third tri-glide buckle, and a spring loaded cam buckle having a position release tab wherein a second cord loop is connectively attached to said quick release tab and said second cord loop is wrapped with a cord covering, and a d-ring operatively connected between said first strap and said second strap on a rifle having a barrel end and a stock end for use of said rifle while said rifle sling is operatively attached comprising attaching a short attachment end having a short cord loop connectively attached to a first loop lock to said barrel end of said rifle by looping said short cord loop through a first opening on said barrel end and passing said first loop lock through said short cord loop, looping said first strap through said first loop lock, attaching a long attachment end having a long cord loop connectively attached to a second loop lock to said stock end of said rifle by looping said long cord loop through a second opening on said stock end and passing said second loop lock through said long cord loop, looping said second strap through said second loop lock, positioning said first strap along side said rifle, positioning said second strap along side said rifle, folding said second strap to remove any slack between said rifle and said rifle sling, and positioning and locking said position release tab on said spring loaded cam buckle along said first strap tightening said rifle sling to a left and a right side of said rifle.

In an alternate embodiment of the present invention there is a method of using a rifle sling wherein said first strap comprises a first length that is longer than a second length of said second strap.

In an alternate embodiment of the present invention there is a method of using a rifle sling wherein said first strap and said second strap comprise a military specification material.

In an alternate embodiment of the present invention there is a method of using a rifle sling wherein said webbing comprises a military specification material.

In an alternate embodiment of the present invention there is a method of using a rifle sling wherein said webbing comprises a pouch attachment ladder system compliant construction.

In an alternate embodiment of the present invention there is a method of using a rifle sling wherein said first cord loop comprises a shock cord.

In an alternate embodiment of the present invention there is a method of using a rifle sling wherein said second cord loop comprises a shock cord.

In an alternate embodiment of the present invention there is a method of using a rifle sling wherein connectively attached is by means of a first webbing material looped through said first loop lock forming two sides that are then sewn over said short cord loop for short attachment end and a second webbing material looped through said second loop lock forming two sides that are then sewn over said long cord loop for long attachment end.

In an alternate embodiment of the present invention there is a method of using a rifle sling wherein said short cord loop and said long cord loop comprise positive locking cord.

The invention has been described by way of examples only. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims.

Although the invention has been explained in relation to various embodiments, it is to be understood that many other possible modifications and variations can be made without departing from the spirit and scope of the invention.

The invention claimed is:

1. A rifle sling comprising a first strap comprising
- a first tri-glide buckle,
- a second tri-glide buckle,
- a webbing,
- a web dominator having a first cord loop comprising a pull tab connectively attached to said first cord loop,
- a second strap comprising a third tri-glide buckle,
- a spring loaded cam buckle having a position release tab wherein a second cord loop is connectively attached to said position release tab and said second cord loop is wrapped with a cord covering, and
- a d-ring operatively connected between said first strap and said second strap.

2. The rifle sling of claim 1 wherein said first strap comprises a first length that is longer than a second length of said second strap.

3. The rifle sling of claim 1 wherein said first strap and said second strap comprise a military specification material.

4. The rifle sling of claim 1 wherein said webbing comprises a military specification material.

5. The rifle sling of claim 1 wherein said webbing comprises a pouch attachment ladder system compliant construction.

6. The rifle sling of claim 1 wherein said first cord loop comprises a shock cord.

7. The rifle sling of claim 1 wherein said second cord loop comprises a shock cord.

8. The rifle sling of claim 1 comprising a short attachment end comprising a short cord loop connectively attached to a first loop lock, and a long attachment end comprising a long cord loop connectively attached to a second loop lock wherein said long cord loop is longer than said short cord loop.

9. The rifle sling of claim 8 wherein connectively attached is by means of a first webbing material looped through said first loop lock forming two sides that are then sewn over said short cord loop for short attachment end and a second webbing material looped through said second loop lock forming two sides that are then sewn over said long cord loop for long attachment end.

10. The rifle sling of claim 8 wherein said short cord loop and said long cord loop comprise positive locking cord.

11. A method of using a rifle sling comprising a first strap comprising a first tri-glide buckle, a second tri-glide buckle, a webbing, a web dominator having a first cord loop comprising a pull tab connectively attached to said first cord loop, a second strap comprising a third tri-glide buckle, a spring loaded cam buckle having a position release tab, a second cord loop wrapped with a cord covering, and a d-ring operatively connected between said first strap and said second strap on a rifle having a barrel end and a stock end for use of said rifle while said rifle sling is operatively attached comprising attaching a short attachment end having a short cord loop connectively attached to a first loop lock to said barrel end of said rifle by looping said short cord loop through a first opening on said barrel end and passing said first loop lock through said short cord loop, looping said first strap through said first loop lock, attaching a long attachment end having a long cord loop connectively attached to a second loop lock to said stock end of said rifle by looping said long cord loop through a second opening on said stock end and passing said second loop lock through said long cord loop, looping said second strap through said second loop lock, positioning said first strap along side said rifle, positioning said second strap along side said rifle, folding said second strap to remove any slack between said rifle and said rifle sling, and positioning and locking said position release tab on said spring loaded cam buckle along said first strap tightening said rifle sling to a left and a right side of said rifle.

12. The method of claim 11 wherein said first strap comprises a first length that is longer than a second length of said second strap.

13. The method of claim 11 wherein said first strap and said second strap comprise a military specification material.

14. The method of claim 11 wherein said webbing comprises a military specification material.

15. The method of claim 11 wherein said webbing comprises a pouch attachment ladder system compliant construction.

16. The method of claim 11 wherein said first cord loop comprises a shock cord.

17. The method of claim 11 wherein said second cord loop comprises a shock cord.

18. The method of claim 11 wherein connectively attached is by means of a first webbing material looped through said first loop lock forming two sides that are then sewn over said short cord loop for short attachment end and a second webbing material looped through said second loop lock forming two sides that are then sewn over said long cord loop for long attachment end.

19. The method of claim 11 wherein said short cord loop and said long cord loop comprise positive locking cord.

* * * * *